US007004351B1

(12) United States Patent
Boman

(10) Patent No.: US 7,004,351 B1
(45) Date of Patent: Feb. 28, 2006

(54) DIFFERENTIATOR FOR VENDING MACHINE AND THE LIKE

(76) Inventor: Bertho Boman, 11600 NW., 20th St., Fort Lauderdale, FL (US) 33323-2060

( * ) Notice: Subject to any disclaimer, the term of this patent is extended or adjusted under 35 U.S.C. 154(b) by 267 days.

(21) Appl. No.: 10/645,753

(22) Filed: Aug. 21, 2003

(51) Int. Cl.
*B65H 1/08* (2006.01)

(52) U.S. Cl. ..... 221/232; 221/268

(58) Field of Classification Search ..... 221/268, 221/232, 274, 272, 238, 236; 271/139, 42
See application file for complete search history.

(56) References Cited

U.S. PATENT DOCUMENTS 3,304,082 A * 2/1967 Cunningham ..... 271/42
4,541,670 A * 9/1985 Morgenstern et al. ... 297/284.7
4,770,321 A * 9/1988 Anderson ..... 221/100
5,273,270 A * 12/1993 Taketsugu et al. ..... 271/139

* cited by examiner

*Primary Examiner*—Kenneth Noland
(74) *Attorney, Agent, or Firm*—Kenneth E. Merklen

(57) ABSTRACT

A differentiator for a vending machine includes a drive motor which drives a threaded shaft. A carrier with a port adapted to receive the threaded shaft defines the base of the differentiator with the head of the differentiator pivotally mounted on the base. A biasing spring between the base and the head urges the head into an angular orientation. A surface which supports a stack of items marketed by the vending machine provides an environment in which the differentiator works. The differentiator is mounted under the support surface. The support surface includes a slot therein. The differentiator is mounted so that differentiator head, on the differentiator base is positioned in the slot of the support surface. One end of the angularly oriented head extends above the support surface, through the slot and, when carried forward by the base, separates an item from the stack of items supported on the support surface. When carried backward by the base, the angular orientation of the head is overcome by items in the stack, which overcome the bias and flatten the position of the head. Escape, by the head, from the influence of the stack, urges the head to an angular orientation.

16 Claims, 4 Drawing Sheets

DIFFERENTIATOR FOR VENDING MACHINE AND THE LIKE

BACKGROUND OF THE INVENTION

1. Field of the Invention

The present invention relates to differentiating devices and systems for differentiating singular units from a stack of a plurality of units, useful for separating and dispensing single units, one at a time from a stack of a plurality of such units in vending machines and the like.

2. Prior Art

Devices and systems for differentiating single units from a stack of a plurality of units is well known. In the apparel manufacturing industry, automated assembly of apparel is made practical because of the use of differentiating devices. Such devices separate single units of pre-cut patterns from a stack of a plurality of units of similar pre-cut patterns of material. Vending machines, which dispense merchandise in single units or packages, use a differentiating system for separating a single item or package, from a plurality of similar items or packages, for dispensing the differentiated item to a purchaser using the vending machine to make such purchase.

The character of the packaging of the merchandise presented for sale in a vending machine influences the structure of the differentiating device. Differentiating a single unit from a plurality of units, such as in a vending machine, must be accomplished without defacing or damaging the package retaining the goods and the goods must be presented to the purchaser undamaged. Endless belts, supporting spaced pushers, have been used to separate a single unit from a plurality of units but the belt surface between the spaced pushers must be slippery to the surface of the packaging in order to avoid separating more than one package at a time from the stack of packages. Further, the spacing of the spaced pushers attached to the endless belt must be precisely measured, relative to the size of the package to be differentiated and strongly secured to the endless belt. The number of pushers secured to the endless belt is controlled by the space between pushers and the length of the belt. The length of the belt is limited by the width of the vending machine. These factors limit greatly the size of the package that may be handled by the differentiator.

SUMMARY OF THE INVENTION

The present invention provides an improved differentiator and differentiating system particularly useful in differentiating a single package or unit from a stack of packages or units, such as in a vending machine or the like. In differentiating a single package or unit from a stack of packages or units, a differentiator is provided that selects a single unit from a stack of units, contacts the selected unit and differentiates or separates the selected unit from the stack of units and dispenses the selected unit, as desired.

The improved differentiator provides a dolly or carrier defining a differentiator base. A differentiator head is pivotally mounted on the base. The differentiator base is driven forward and backward beneath a stack of units, supported on a surface, from which stack one unit is to be separated or differentiated. As the base travels its forward and reverse paths, the differentiator passes under a stack of units supported on the surface above the base. The support surface is provided with an open track or slot which extends beneath the stack of units. The differentiator head is mounted on the base by a mount which permits the differentiator head to ride in the open track, on essentially the same plane as the plane of the support surface or at an angular orientation in the open track so that the differentiator head cuts the plane of the support surface. A bias means between the differentiator base and the differentiator head urges the head to an angular orientation with respect to the plane of the support surface in absence of an opposing pressure on the differentiator head. With an opposing pressure applied to the differentiator head, the angular orientation of the differentiator head changes. During the separating and dispensing stages of the differentiating cycle, the differentiator head is angularly oriented on its mount, with the leading edge of the differentiator head extending angularly above the support surface and the trailing edge of the differentiator head extending angularly below the support surface. When the differentiator retreats back to its "start" position, from its extreme forward drive position, the angular orientation of the head of the differentiator is unchanged with respect to the plane of the support surface, however, during the return travel of the differentiator head, in the differentiating cycle, the trailing edge of the differentiator head, which extends under the plane of the support surface, approaches the stack of items from below the plane of the support surface. As the advancing end of the trailing edge of the differentiator head passes under the bottom of the lower most item in the stack, the upper surface of the differentiator head progressively rises, with respect to the plane of the support surface and the bottom of the lower most item in the stack, making contact with the near edge of the bottom most unit in the stack.

When the upper surface of the head of the differentiator comes in contact with the near edge of the bottom of the lower most unit in the stack of units, the weight or pressure of the stack of units is applied to the upper surface of the differentiator head, overcoming the bias applied the differentiator head. The differentiator head pivots, on its mounting axis, toward an angular orientation that approaches a parallel relationship with the plane in which the support surface lies. The differentiator head passes under the items in the stack in an orientation that is substantially parallel with the support surface When the differentiator fully passes under the bottom unit in the stack, the leading edge of the head of the differentiator will escape the pressure or weight opposing the urging pressure of the biasing means. The bias means, between the head and the base, will urge the differentiator head to an angularly oriented position, with leading edge of the differentiator head above the plane of the support surface, the level of the differentiator head progressively decreasing along its length, with respect to the plane of the support surface, and the trailing edge of the differentiator head below the plane of the support surface.

A drive means is provided for driving or moving the differentiator base, and therefore the differentiator head mounted on the base, in reciprocal travel, passing, back and forth, under the stack of items. The drive means may be an electric motor, a pneumatic motor or an hydraulic motor. The motor may be rotary or linear. Preferably, the drive means provided for driving the differentiator base and differentiator head mounted on the base is defined by an unidirectional, rotary electric motor. A shaft is connected to the electric motor for rotating the shaft on the major axis of the shaft. A section of the length of the shaft is cut with dual or bidirectional threads, with turn-around threads at both ends of the section of bidirectional threads. The differentiator base is provided with a port adapted to receive the shaft. A thread follower means or rider is coupled to the base, preferably at the port, for example, for riding in the threads cut in the surface of the shaft for moving the base along the shaft in response to rotation of the shaft in the port. When the shaft is rotated by the motor, the thread follower or rider, riding in one thread of the dual threads cut in the shaft, urges the base along the shaft, in a first linear direction, to an end of the section of threads. At the end of the section of threads, the rider is directed to the second of the dual threads, by a turn-around, and the thread follower, riding in the second thread of the dual threads urges the base along the shaft, in a second linear direction. The distance of travel of the base, along the shaft is a function of the length of the section of threads cut in the shaft.

Alternatively, the drive means may be a bidirectional motor with a shaft connected to the motor for rotating the shaft on a major axis of the shaft. Single or unidirectional thread is cut in the surface of the shaft. The differentiator base includes a port adapted to receive the shaft. The surface of the port is cut with threads that adapted to cooperate with the threads cut in the surface of the shaft. The base moves linearly along the shaft in response to rotation of the shaft, by the bidirectional motor. When the motor drives clockwise, for example, the shaft rotates in a first rotational direction and the base moves along the shaft in a first linear direction. When the motor drives counterclockwise, for example, the shaft rotates in a second rotational direction and the base moves along the shaft in a second linear direction. In both of the above structure, the base is restrained from rotating with the shaft.

In an alternative structure of the invention, the drive means may be a linear drive motor, either electric, pneumatic or hydraulic. A linear drive motor, a solenoid, for example, may be connected to the differentiator base and move the differentiator base linearly, on a forward and reverse course.

The differentiator base, on which the differentiator head is mounted, provides an adjustable stop for adjusting the angular limits of the angular orientation or attitude of the differentiator head. A remote switch, operated by a presence detector, which detects the presence and/or absence of items or packages in the stack of items or packages, functions as an override switch, permitting the finish of a working cycle, but preventing the initiation of a new cycle of operation when the stack becomes empty of items.

The differentiator base is mounted under a support surface. The support surface supports a chamber or other means for holding a stack of items or packages from which units or packages, one at a time, for example, are differentiated or separated. The support surface is provided with an elongated opening or slot which passes under the chamber and extends beyond opposite edges thereof. The chamber is provided with a front opening and a back opening at the level of the support surface, each opening extending over the slot. The differentiator base is mounted on the shaft so that the base moves along a path that is under the support surface and substantially parallel to the slot in the support surface. The differentiator head is pivotally mounted on the differentiator base so that the differentiator head rides substantially in the open slot in the support surface, A bias means, between the base and the differentiator head, urges the head into an angular orientation, with respect to the plane of the support surface. With pressure applied on the upper portion of the pivotally mounted differentiator head, the urge pressure of the bias means is overcome and the angular orientation of the head is changed, driving the differentiator head toward an angular orientation which is substantially parallel to the plane of the support surface and in alignment with the slot.

The improved differentiating system for a vending machine or the like provides a partly open chamber for holding a stack of items or packages, such as packages of candy or cigarettes, for example. The chamber is preferably mounted so that the stack of items held in the chamber is supported on the upper surface of a support surface. The support surface has an elongated opening or slot therein which extends under the chamber and beyond the front and rear edges of the chamber. The chamber has a front opening and a rear opening at the level of the support surface, with each opening over the slot in the support surface. The front opening serves as a port for an item in the stack of items, and an exit and entrance port for the moving differentiator head. The rear opening serves as an entrance and exit port for a differentiator head.

The differentiator head rides in the slot in the support surface. The differentiator head is pivotally mounted on a differentiator base which is mounted under the support surface, in alignment with the slot in the support surface. The differentiator base is mounted on a drive assembly that positions the differentiator base under the support surface and aligned with the slot so that the differentiator head, mounted on the base rides in the slot. The drive assembly provides the drive means for moving the differentiator base along the slot in the support surface. The differentiator base rides back and forth on a threaded shaft, as the shaft rotates. The drive assembly includes a rotary motor and a threaded shaft connected thereto. The differentiator head, mounted on the base, rides in the slot.

In a preferred embodiment of the invention, a unidirectional motor is provided with a connecting shaft mounted under the support surface. A section of the shaft is cut with dual or bidirectional threads, with turnaround threads cut at each end of the section. The threaded shaft extends substantially parallel to the slot in the support surface. The differentiator base is provided with a port adapted to receive the dual threaded shaft. A thread follower or rider, associated with the port and coupled to the base, rides in a thread of the dual threads on the shaft. When the dual threaded shaft is in the port of the base and the shaft rotates, the rider moves along a thread of the dual threads of the shaft, urging the differentiator base along the shaft. As the base moves along the shaft, the differentiator head, mounted on the base, rides in the slot in the support surface. The differentiator base is stabilized from rotating with the threaded shaft.

The length of travel of the base along the dual threaded shaft is a function of the length of the section of the dual threads between the turn around threads. The motor is programmed to drive the shaft rotationally so that the differentiator base moves along the shaft, from a start position, through a cycle of differentiation and return. From the start position, the differentiator head is moved through the slot in the support surface toward the chamber which holds the stack of items. The item in the stack, adjacent the support surface is differentiated or separated from the stack and dispensed therefrom. The differentiator reverses its direction of travel and moves toward the chamber, under the stack, back to the start position and stops. The cycle of differentiation is completed.

In order to avoid cycling the differentiator when the chamber is empty, a presence detector is provided which interrupts initiation of the cycle of differentiation. The presence detector is responsive to the weight or presence of at least one item in the stack of items in the chamber holding the stack of items. A finger, extending through the support surface from below the support surface, is depressed through the support surface and rotates or partially rotates a lever which operates a remote switch means which permits the cycle of differentiation to finish but interrupts the initiation of the next cycle and provides indication that the chamber is empty of items.

BRIEF DESCRIPTION OF THE DRAWINGS

FIG. 5*a*' is a view of the representation shown in FIG. 5*a*, along the lines 5*a*'—5*a*' of FIG. 5*a;*

DETAILED DESCRIPTION OF THE INVENTION

Figure 1:
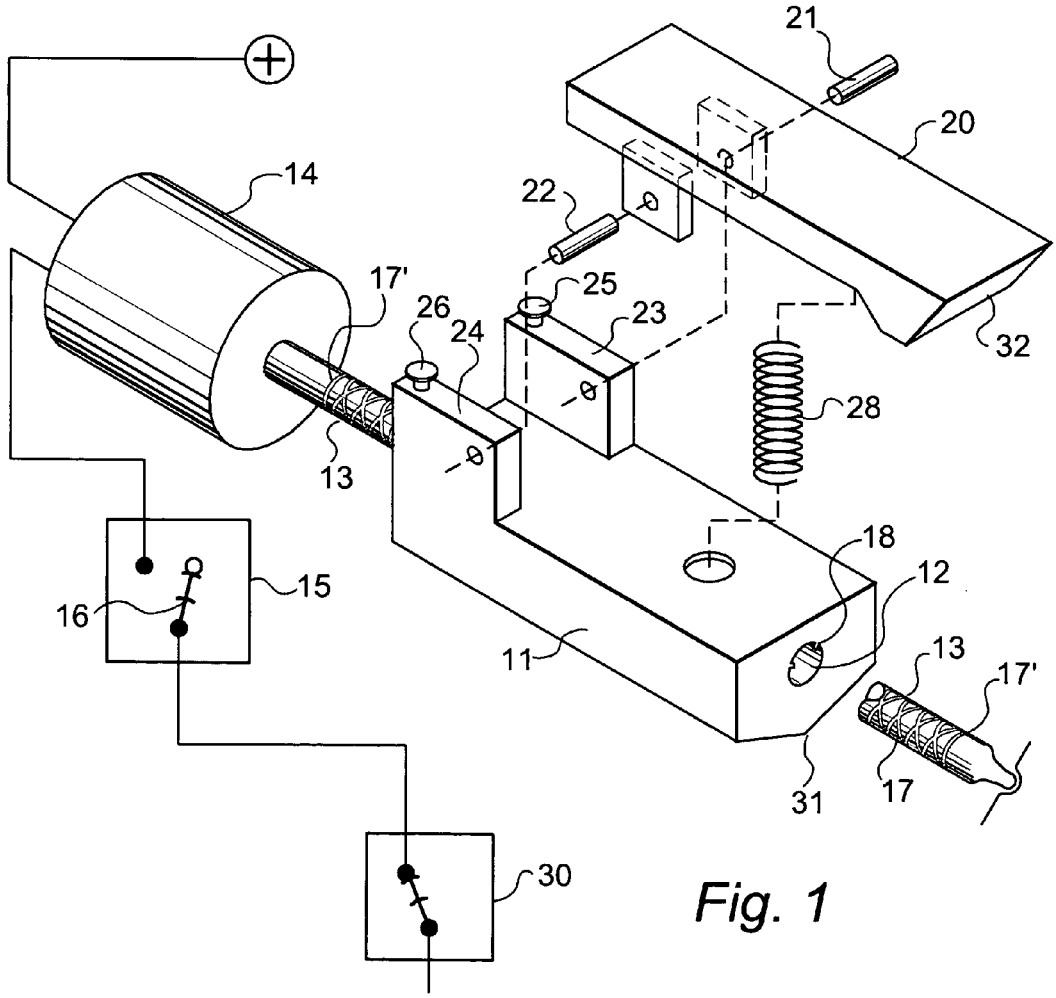
FIG. 1 is a representation of the invention, in partial exploded form.
Figure 6:
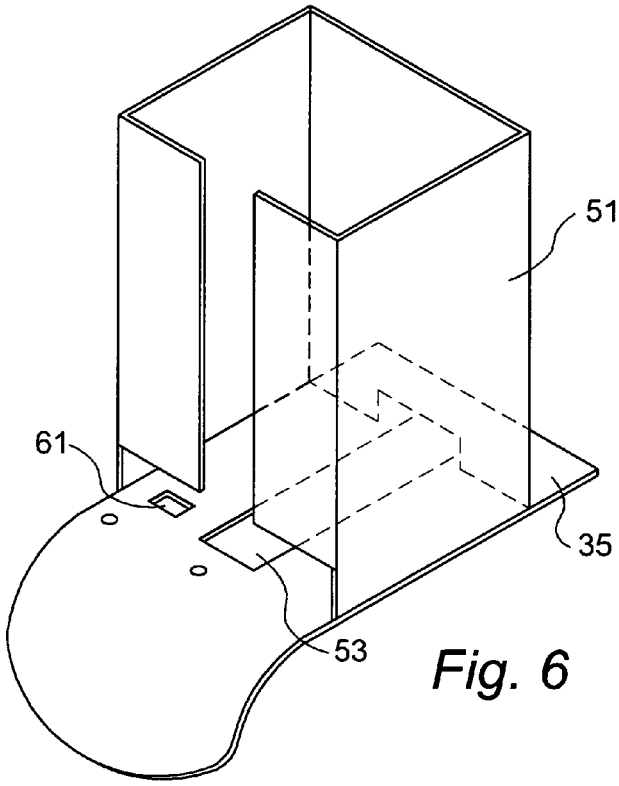
FIG. 6 is a representation of a chamber usable with the invention.
Figure 8B:
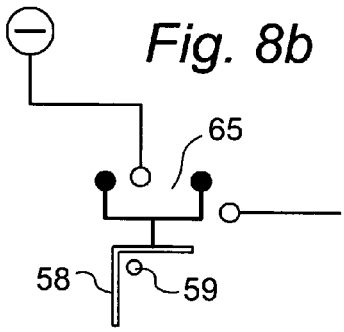
FIGS. 8*a* and 8*b* represent frontal and rear views of the presence detector represented in FIG. 7, when the chamber is empty.

A preferred embodiment of the invention is represented, in partial exploded view, in FIG. 1. The invention is preferably mounted in a vending machine under a support surface associated with a structure that supports a stack of packages or items, which are to be dispensed by the vending machine. The purpose of the invention is to reliably differentiate, or separate, without damage thereto, packages or items, one at a time, from a stack of packages or items and deliver the differentiated package or item to a delivery or dispensing area or drop. FIG. 6 represents a structure which defines an open chamber for supporting a stack of packages or items, with a support surface for the chamber and stack retained therein. The invention is mounted under the support surface, which is slotted. The slotted support surface and the differentiator cooperate in the function of the invention. With reference to FIG. 1, a differentiator base 11 includes a port 12 adapted to receive a shaft 13. The shaft 13 has a section of its surface cut with dual threads 17 with a turn-around 17' at each end of the threaded section. The shaft 13 is connected to a drive means, such as rotary motor 14. The motor may be unidirectional. A thread follower or thread rider 18 is coupled to differentiator base 11 and positioned for riding in a thread of the dual threads 17. The panel 15, with a switch 16, represents a control assembly for controlling activation of the motor for initiation of a cycle of differentiation. The control assembly may include means, not shown, at an end of the slot in the support surface, for stopping the motor. This technology is well known. A differentiator head 20 is mounted on the base with axel 21 and 22. The mounting shoulders 23 and 24 each include adjustable bumpers 25 and 26 which are used to adjust the angle to which the differentiator head may be urged by the bias spring 28. The panel 30 represents an override switch represented in FIGS. 7, 8*a*, 8*b*, 9*a* and 9*b*. The differentiator base 11 has a V bottom 31, which rides in a V channel of the vending machine to prevent the base from rotating. This feature is shown in broken line form.

Figure 3:
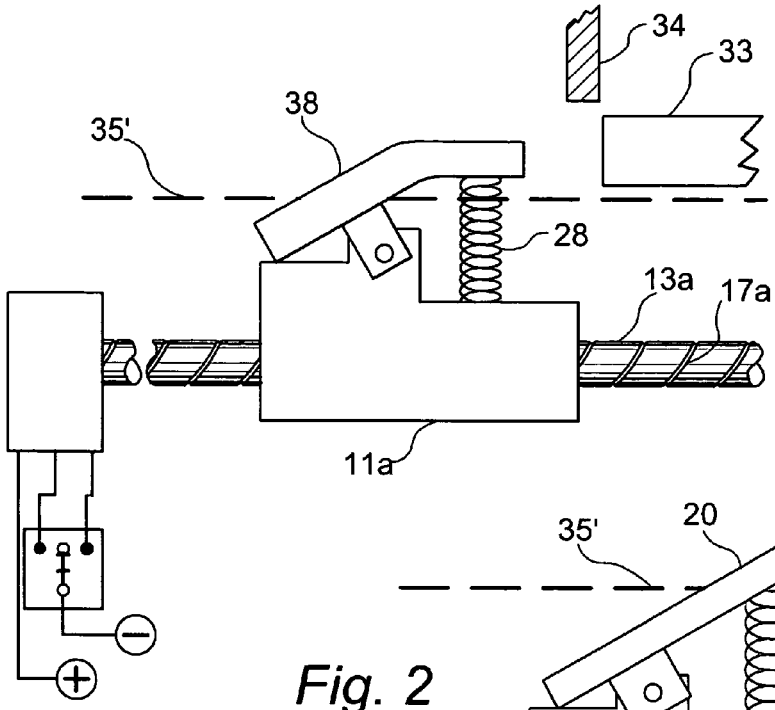
FIG. 3 is a representation of an alternate embodiment of the invention.
Figure 2:
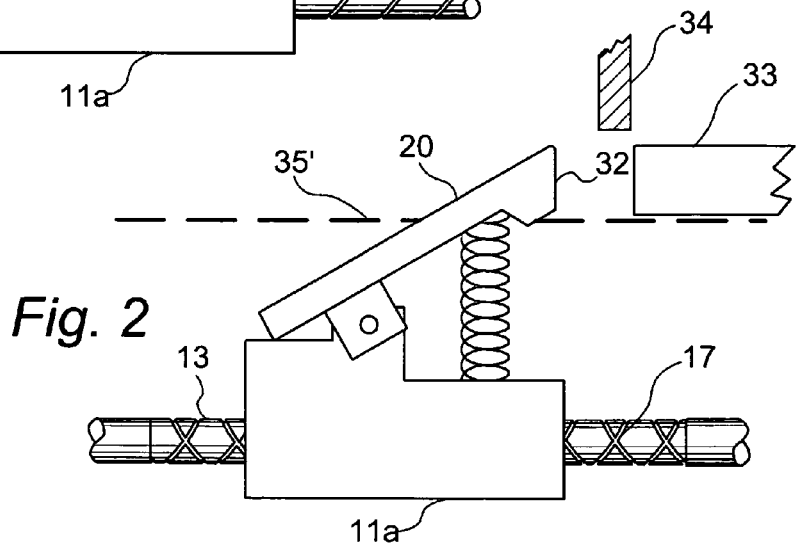
FIG. 2 is a representation of a preferred embodiment of the invention.

FIG. 2 represents a differentiator base 11*a* on a dual thread shaft 13 with a preferred embodiment of differentiator head 20 pivotally mounted on the base. The face 32 is at an acute angle on the head, so that the face is substantially at normal when the head is angularly oriented by the bias spring 28. The vertical face makes contact with the bottom-most item 33 in a stack of items held in a chamber defined by wall 34. In its angular orientation the head 20 cuts the plane 35' in which the support surface 35 lies. The slot 53 in the support surface 35 is more clearly shown in FIG. 6. Although the preferred embodiment of the differentiator head is a generally straight structure with a substantially planar upper surface and a facial end cut at a reverse angle with respect to its upper surface, other shapes of differentiator head may be used, if desired. FIG. 3 represents alternate embodiment of the invention in which the elongated differentiator head 38 is angular. The shaft 13*a* has a single thread 17*a* cut in its surface. The port (not shown in FIG. 3) in the base 11*a* is a threaded port and adapted to receive the threads 17*a* of the shaft 13*a*. The drive means, for rotating the shaft 13*a* is a bidirectional drive means. This alternate embodiment will also include control means for reversing the bidirectional drive means which is well known technology. Another alternate embodiment of the invention may provide a differentiator head in an elongated curve, with face defined by an end surface in reverse angle. Throughout these Figures, similar elements are identified with identical call-out numbers.

Figure 4:
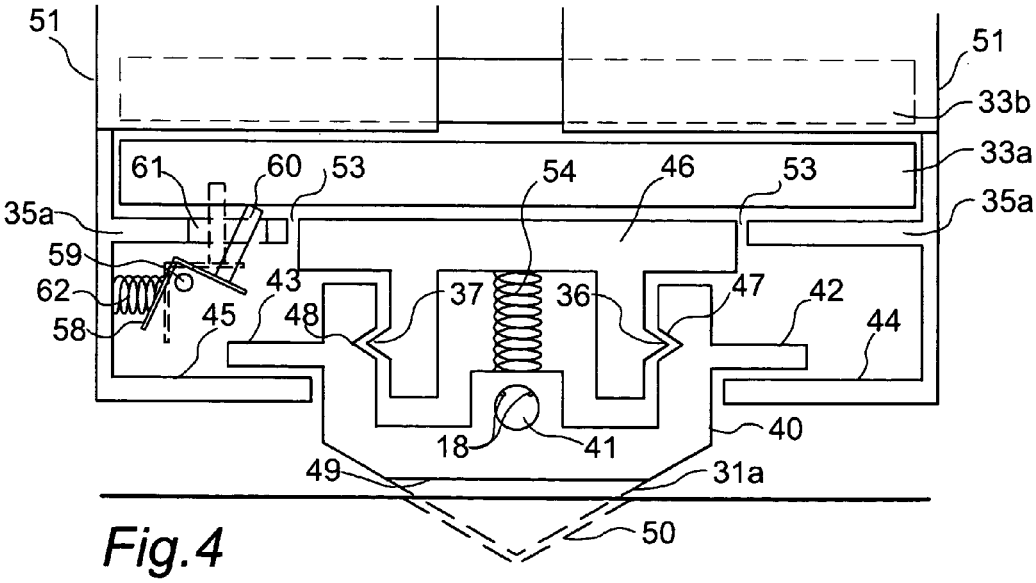
FIG. 4 is a representation, in cross-section view of the invention with alternate mounting and stabilizing structure.

FIG. 4 represents another embodiment of the invention, seen in a cross-section end view. The differentiator base 40 includes a threaded port 41 adapted to receive a threaded shaft, not shown, on which the base rides. Stabilizing planes 42 and 43 extend from the base over the shoulders 44 and 45, for preventing rotation of the base 40 when the threaded shaft in the threaded port rotates. The bottom of the base at 49 is flat. The broken line extension of the base 40 at 31*a*, represents a V structure, as seen at 31 in FIG. 1. The V shaped bottom of the base at 31*a* rides in a V shaped channel 50, also shown in broken line form, which stabilizes the base and prevents rotation of the base when the threaded shaft in the threaded port is rotated. Either the V shaped bottom in the V shaped channel or the horizontal stabilizers and shoulders (42/44 and 43/45) may be used for stabilizing the base. Other stabilizing means may be used, if desired. Mounting and pivot means for the differentiator head 46 on the differentiator base 40 are defined by sets of extension pins 36 and 37 and cooperating recesses 47 and 48.

An open chamber formed by walls 51 holds a stack of items 33*a*, 33*b*. A support surface 35*a* has a slot 53 in which the differentiator head 46 rides. The differentiator head 46 is held substantially parallel to the supporting surface, as the weight of the stack 33*a*, 33*b* overcomes the urging force of the bias spring 54.

Figure 9B:
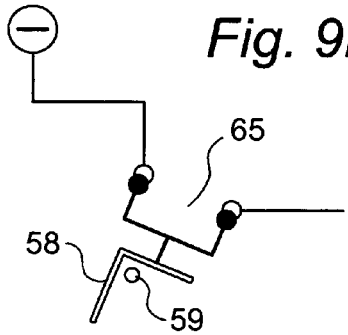
FIGS. 9*a* and 9*b* represent frontal and rear views of the presence detector represented in FIG. 7, when one or more items are in the chamber; and, FIG. 10 represents an alternate embodiment of the invention.
Figure 8A:
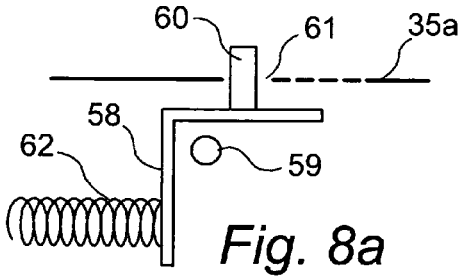
Figure 9A:
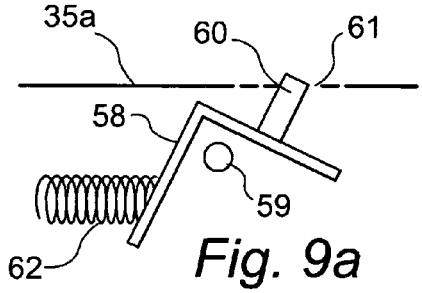

A sensor or presence detector head for an over-ride switch, which is represented in more detail in FIGS. 7, 8*a*, 8*b*, 9*a* and 9*b* is represented beneath the support surface 35*a*. A rotatable arm 58 rides on a shaft 59. A contact finger 60 extends from the arm 58. A biasing spring 62 urges the arm in a direction which drives the finger 60 into the chamber through a port 61 in the support surface 35*a*. As represented in FIG. 4, the weight of the stack of items on the finger 60 overcomes the force of the bias spring 62, rotating the arm 58 on the shaft 59, closing the contacts at 65, as represented in FIGS. 9*a* and 9*b*. When the chamber is empty, the bias spring 62 urges the arm 58 rotationally, driving the finger 60 into the chamber, through a port 61 in the support surface 35*a*. The rotational position of the arm opens and/or closes the switch 65. When closed switch 65 permits an actuating signal to energize the control circuit for starting a cycle of operation of the differentiator. The override switch 65 is wired into the control circuit in such a way that when the switch becomes open during the differentiating cycle, the cycle will continue to the end thereof but a new cycle of differentiation can not start until the switch 65 is closed.

Figure 5A:
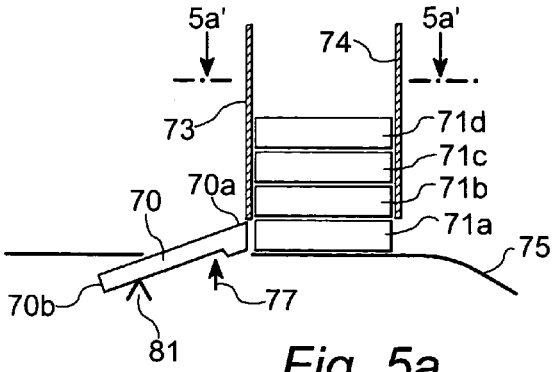
FIGS. 5*a*, 5*b*, 5*c*, 5*d* and 5*e* are a series of representations of stages in a cycle of operation of the invention.
Figure 5A:
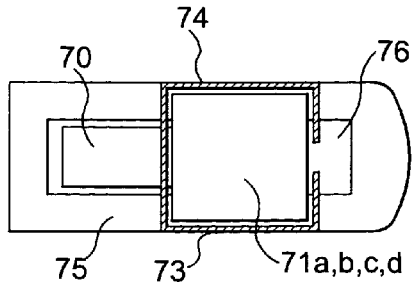
Figure 5C:
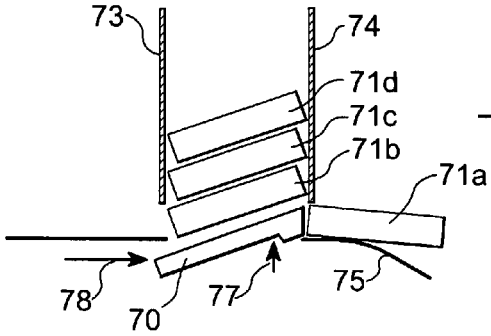
Figure 5B:
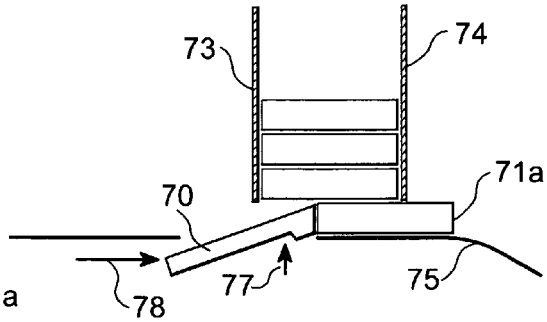
Figure 5D:
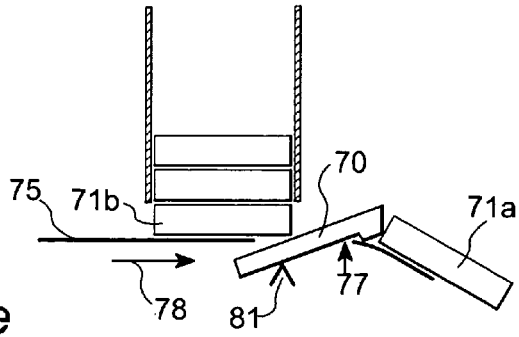
Figure 5E:
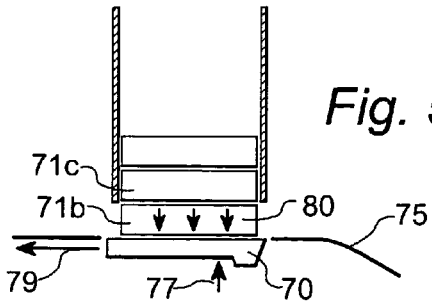
Figure 7:
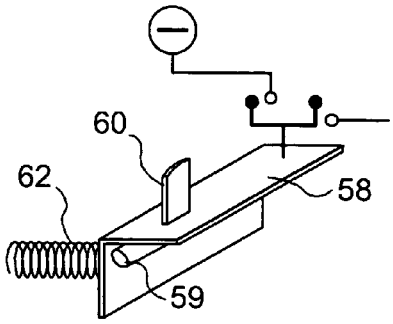
FIG. 7 is a representation of a presence detector usable with the invention, in association with the chamber.

FIGS. 5*a*, 5*b*, 5*c*, 5*d* and 5*e* represent steps in a cycle of operation of the differentiator as the differentiator, starting from a stop/start position, advances toward a stack of items, separates the bottom-most item from the stack and delivers the separated item to a dispensing chute, for example. After delivery of the item to the dispensing chute, the differentiator is driven in reverse direction, returning to the stop/start position. The differentiator is represented by the differentiator head 70. The head, which rides in the slot 76, is angularly oriented, with respect to the support surface 75, that the face 70*a*, of the head, extends above the support surface 75 and the end 70*b* extends below the support surface 75. The differentiator in FIG. 5*a* is represented at stop/start position with a bias means, arrow 77, urging the pivotally mounted 81 differentiator head upward, at the face 70*a*. Walls 73 and 74 represent a structure which defines an open chamber for holding a stack of items or packages 71*a*, 71*b*, 71*c* and 71*d*. The support surface 75 supports the walls, serves to define one end of the chamber and supports the stack of items in the chamber. The support surface 75 has a slot 76 that extends across the end of the chamber defined by the support surface and extends beyond the outer walls thereof, as shown more clearly in FIG. 5*a*', a top view along the lines 5*a*'—5*a*' in FIG. 5*a*. The head 70 is angularly disposed in the slot 76. The arrow 78 represents the direction of forward travel of the differentiator head in the slot. The arrow 79 represents the direction of reverse travel of the head in the slot. The arrows 80 in the item or package 71*b* in FIG. 5*e*, represent the weight or pressure applied to the head by the item or items in the stack.

FIG. 5*d* represents the differentiator head 70 in its full forward position. When the base or carriage of the differentiator carries the head to the extreme forward position, by operation of the rotating threaded shaft, the motor driving the shaft is stopped and driven in reverse rotation, reversing the directional drive of the shaft and reversing the direction of the differentiator base and head, as represented by arrow 79. The head remains angularly disposed but the leading edge of the differentiator is below the level of the support surface with the trailing edge of the head extending above the level of the support surface. As the differentiator head travels in reverse direction the leading edge of the head advances under the stack in the chamber. When the upper surface of the head comes in contact with the item in the stack, the weight or pressure exerted on the head, drives the head to pivot on the fulcrum mount 81 toward an orientation that is substantially parallel to the plane in which the support surface lies, such as represented in FIG. 5*e*. Thus, the differentiator passes under the stack.

As seen in FIG. 5*a*', the items in the stack 71*a, b, c, d* are broader or wider than the slot 76 is wide. This permits the items in the stack to drop angularly, as the bottom-most item is being removed from the stack (FIGS. 5*b*, 5*c* and 5*d*) without interfering with the progress of the differentiator.

FIG. 6 represents the walls 51 that define an open chamber. The support surface 35 supports the walls and defines the lower end of the chamber. The support surface includes a slot 53 in which the differentiator head rides. The chamber has a front opening across the face of the chamber and a back opening partly across the back. The differentiator base and differentiator head, the drive means and the override switch are mounted under the support surface. The presence detection member of the override switch extends into the chamber. The differentiator head rides in a slot in the support surface. The chamber defining walls and the support surface provide a working environment for the differentiator.

Figure 10:
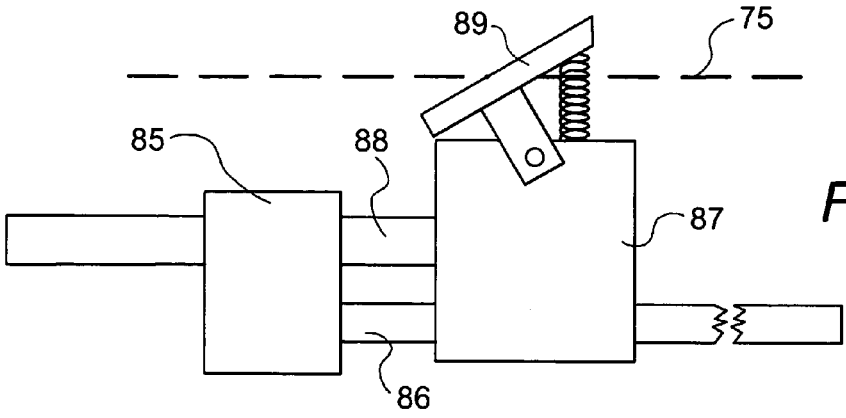

FIG. 10 represents another alternate embodiment of the invention in providing a linear drive assembly. A solenoid 85 has a shaft 86 extending therefrom. A differentiator base 87 which includes a port (not shown) is mounted on the shaft, for linear movement thereon. A ring or guide means connected to the base 87 and adapted to receive the shaft, may be substituted for the port, if desired. The differentiator is mounted under a support surface 75, represented in broken line form. The arm 88 of the solenoid drive is connected to the differentiator base 87 and, when the solenoid is activated the differentiator moves along the shaft. The differentiator base 87 has mounted thereon a differentiator head 89 which is positioned and rides in a slot in the support surface 75.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with alternative constructions and suggested changes, other changes that may become apparent to those skilled in the art may be made, without departing from the scope of the invention defined in the appended claims.

What is claimed is:

1. An apparatus for differentiating an item from a stack of items supported on a surface, said surface having a slot therein, extending at least across the base of said stack, said apparatus comprising:

a) a drive means including a shaft member adapted to be received in a guide means, said shaft member mounted under said surface, with respect to said stack of items and aligned with said slot in said surface;

b) a base member connected to said guide means and adapted for receiving said shaft member for carrying said base member along said shaft member;

c) a head member and a mounting means for mounting said head member on said base member, said mounting means providing for pivotal movement of said head member about said mounting means; and d) a bias means coupled between said base member and said head member for urging said head member into an angular orientation with respect to said surface, said head member positioned on said base member for extending into said slot in said surface when said head member is in said angular orientation.

2. An apparatus for differentiating an item from a stack of items as in claim 1 wherein said shaft member is a threaded shaft and said threaded shaft includes dual threads defining a section on said shaft member with turn-around threads at each end of said section.

3. An apparatus for differentiating an item from a stack of items as in claim 1 wherein said drive means is a rotational drive means.

4. An apparatus for differentiating an item from a stack of items as in claim 2 wherein said drive means is an unidirectional drive means.

5. An apparatus for differentiating an item from a stack of items as in claim 2 and further including thread follower means coupled to said base member and adapted to receive and ride in a thread of said dual threads of said threaded shaft for moving said base member along said threaded shaft.

6. An apparatus for differentiating an item from a stack of items supported on a surface, said surface having a slot therein, extending at least across the base of said stack, said apparatus comprising:

a) a drive means including a shaft member adapted to be received in a guide means, said shaft member mounted under said surface, with respect to said stack of items and aligned with said slot in said surface;

b) a base member connected to said guide means and adapted for receiving said shaft member for carrying said base member along said shaft member;

c) a head member and a mounting means for mounting said head member on said base member, said mounting means providing for pivotal movement of said head member about said mounting means;

d) a bias means coupled between said base member and said head member for pivotally urging said head member into an angular orientation with respect to said surface, said head member positioned on said base member for extending into said slot in said surface when said head member is in said angular orientation and said base member includes an adjustable means between said base member and said head member for limiting the maximum extent of angular orientation to which said head member may be urged by said bias means.

7. An apparatus for differentiating an item from a stack of items as in claim 6 and in which said adjustable means is a screw means threaded into a threaded hole in said base member.

8. An apparatus for differentiating an item from a stack of items as in claim 6 wherein said head member is defined by a substantially straight body with a first end and a second end and said first end includes a facing means which is at an acute angle to said body and extends above said surface when said head member is urged into maximum angular orientation.

9. An apparatus for differentiating an item from a stack of items as in claim 6 wherein said head member is defined by an angular body with a first end and a second end and said first end includes a facing means which is substantially at normal to said angular body and said first end extends above said surface when said head member is urged into maximum angular orientation.

10. A differentiating system for a vending machine having a stack of items supported on a support surface with a slot in the support surface extending across said stack of items where a differentiator of said differentiating system separates items one at a time from said stack of items and delivers the separated item to a dispensing area of the vending machine, said differentiating system comprising:

a) a drive means and a threaded shaft member, said threaded shaft member connected to said drive means for rotating said threaded shaft member on a major axis, said threaded shaft member mounted under said support surface, with respect to said stack of items and in alignment with said slot in said support surface, said threaded shaft member adapted to be received in a port means;

b) a differentiator means defined by a base member, a head member, a mounting means, a bias means and a means for stabilizing said base member, said base member including said port means and a thread follower means, said port means adapted for receiving said threaded shaft member for mounting said differentiator means under said support surface and said thread follower means adapted for cooperating with threads of said threaded shaft for moving said differentiator means along said threaded shaft means when said threaded shaft is rotated, said means for stabilizing said base for preventing rotation of said base member with said threaded shaft member, said mounting means for mounting said head member on said base member for rotational movement of said head member on said mounting means and said bias means connected between said base member and said head member for urging said head member to an angular orientation with respect to said support surface; and, c) said threaded shaft member received in said port of said base member for positioning said head member mounted on said base member in said slot of said support surface so that a first end of said head member extends through said slot when said head member is urged into angular orientation by said bias means.

11. A differentiating system for a vending machine having a stack of items supported on a support surface with a slot in the support surface extending across said stack of items where a differentiator of said differentiating system separates items, one at a time, from said stack of items and delivers the separated item to a dispensing area of the vending machine, said differentiating system comprising:

a) a drive means and a threaded shaft member, said threaded shaft member connected to said drive means for rotating said threaded shaft member on a major axis, said threaded shaft member mounted under said support surface, with respect to said stack of items and in alignment with said slot in said support surface, said threaded shaft member adapted to be received in a port means;

b) a differentiator means defined by a base member, a head member, a mounting means, a bias means and a means for stabilizing said base member, said base member including said port means and a thread follower means, said port means adapted for receiving said threaded shaft member for mounting said differentiator means under said support surface and said thread follower means adapted for cooperating with threads of said threaded shaft for moving said differentiator means alone said threaded shaft means when said threaded shaft is rotated, said means for stabilizing said base for preventing rotation of said base member with said threaded shaft member, said mounting means for mounting said head member on said base member for rotational movement of said head member on said mounting means and said bias means connected between said base member and said head member for urging said head member to an angular orientation with respect to said support surface and said base member includes an adjustable stop means for limiting said angular orientation of said head member; and c) said threaded shaft member received in said port of said base member for positioning said head member mounted on said base member in said slot of said support surface so that a first end of said head member extends through said slot when said head member is urged into angular orientation by said bias means.

12. A differentiating system for a vending machine as in claim 11 wherein threads of said threaded shaft member are defined by dual threads cut in a section of a surface of said threaded shaft and said section is defined by turn-around threads at each end of said section.

13. A differentiating system for a vending machine as in claim 12 wherein said drive means is a unidirectional motor.

14. A differentiating system for a vending machine as in claim 11 wherein threads of said threaded shaft are defined by a single thread extending substantially along a length of said threaded shaft and said threaded follower is threads cut in a surface of said port means.

15. A differentiating system as in claim 14 and in which said drive means is a bidirectional, rotary drive means.

16. A differentiating system for a vending machine as in claim 11 and further including a source of power connected to a reversible drive means through a three position switch means for driving said reversible drive means in a first rotational direction in a first position, driving said reversible drive means in a second rotational direction in a second position and for stopping said rotational drive means in a third position; and an override switch means defined by a presence detector which is defined by an arm rotatably mounted under said support surface, with a protraction means coupled to one end of said arm and extending through a port in said support surface into a chamber holding said stack of items and a bias means for urging said protraction means into said chamber, and a contact means at a second end of said arm, said contact means having a closed position and an open position, said open position for preventing initiation of a new cycle of said differentiating system.

* * * * *